United States Patent [19]

Jones

[11] 4,259,538

[45] Mar. 31, 1981

[54] VACUUM FURNACE ARRANGEMENT HAVING AN IMPROVED HEATING ELEMENT MOUNTING MEANS

[76] Inventor: William R. Jones, 244 Hampshire Dr., Chalfont, Pa. 18914

[21] Appl. No.: 117,260

[22] Filed: Jan. 31, 1980

[51] Int. Cl.[3] ..... F27D 11/00; H05B 3/00

[52] U.S. Cl. ..... 13/25

[58] Field of Search ..... 13/20, 22, 25, 31; 219/347, 405, 355

[56] References Cited

U.S. PATENT DOCUMENTS

| | | | |
|---|---|---|---|
| 2,966,537 | 12/1960 | Witucki et al. | 13/25 X |
| 3,654,374 | 4/1972 | Scheyer | 13/31 |
| 3,737,553 | 6/1973 | Kreider et al. | 13/25 |
| 3,812,276 | 5/1974 | Cyrway, Jr. et al. | 13/25 |
| 4,056,678 | 11/1977 | Beall et al. | 13/25 |

*Primary Examiner*—Roy N. Envall, Jr.
*Attorney, Agent, or Firm*—William E. Cleaver

[57] ABSTRACT

The present invention is a vacuum furnace arrangement which in the preferred embodiment is generally cylindrical in shape having a hot zone chamber within, the hot zone chamber has heat insulating material secured to the inside surface of the outside wall. Secured, at several locations, to the outside wall and passing inwardly therefrom, through the heat insulating material, are a number of molybdenum rods. A heating element located in the hot zone chamber, in the preferred embodiment, is a flat strip of molybdenum, formed to approximate a circle, and which has apertures located therein with said rods passing therethrough. At each aperture there is a relatively long electrical insulator sleeve fitted over the rod to keep the rod electrically insulated from the heating element. The long sleeves in turn are held in position, within the aperture by a large disc-like shield on both ends and each of said shields in turn has an aperture through which the rod passes. Each of the shields is restrained by a pin located in the rod. In addition there are included two additional shorter sleeves of electrical insulating material disposed over said long insulating sleeve and between said disc-like shields. The shields and the two shorter sleeves act together to keep the long insulating sleeve from having vaporized material deposited thereon. The deposited material builds up and can eventually cause an electrical short circuit. In addition the shields and short sleeves act with the long sleeve to secure the heating element in place. The rod assembly can be readily disassembled and assembled to permit repairs which often become necessary in vacuum furnaces.

9 Claims, 2 Drawing Figures

VACUUM FURNACE ARRANGEMENT HAVING AN IMPROVED HEATING ELEMENT MOUNTING MEANS

BACKGROUND OF THE INVENTION

Figure 1:
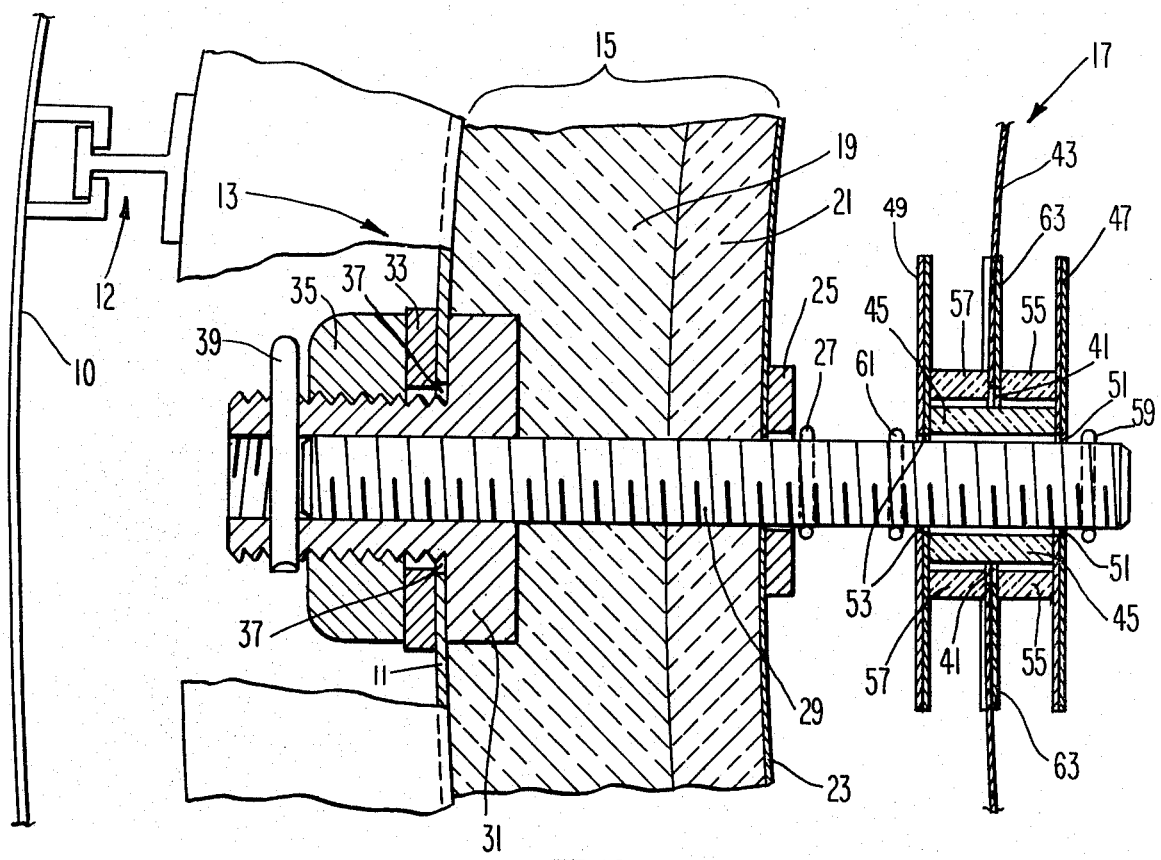

It is well known that in vacuum furnaces the hot zone chambers are usually constructed with a generally cylindrical outer wall, some form of heat shield (to contain the heat within the hot zone chamber) secured to the inside of the outer wall and a heating element formed to generally follow the contour of the inside surface of the outer wall but formed to fit within the hot zone chamber. Such heating elements are subject to expansions and contractions as a result respectively of the heat generated by electrical energy passing therethrough and alternatively as a result of the cooling, experienced when the electrical energy is terminated. Such expansions and contractions cause stresses in the heating element material and eventually resultant fractures occur therein. As a result of such damage it has been the practice to replace the heating element, or at least sections thereof. Hence the need for a mounting means which will enable the heating element to be easily mounted or removed becomes apparent. Despite the apparency of the need for means to permit an easy mounting or easy removing of a heating element or a section thereof, such mounting means has not been provided in the prior art. It is my belief that my present invention fulfills that need.

In addition other infirmities have been inherent in prior art heating element arrangements for vacuum furnaces. The heating elements generally have had apertures therein to accommodate some form of holding means passing therethrough. Such apertures reduce the material through which electrical current may flow hence increasing the current density at such locations and thereby literally burning out such areas. I have provided a means to compensate for the material removed to form the aperture in the heating element, hence negating an increase in current density and removing a major cause for heating element failures.

Another infirmity (to which I made reference above), with respect to the heating element arrangement lies in the fact that the heating element very often gets electrically "shorted out" to the mounting structure by deposits of electrically conducting material (which vaporizes from materials being heated in the furnace), providing the "shorting" paths. The vaporized material "builds up" to provide an electrical path between the heating element and the mounting means which in turn provides an electrical path to ground. Such short circuits result in arcing and destruction of part of the heating element. My present invention dramatically reduces the possibility of short circuits resulting from material build ups caused by vaporized material from work pieces within the heating chamber.

SUMMARY OF THE INVENTION

The present invention provides that the heating element is held in position by the combination of a plurality of long sleeves of electrical insulating material each of which fits over a section of an asociated mounting rod and each of which fits through an associated aperture formed in the heating element, there being a plurality of rods and apertures. Each of the rods is secured to the outside wall of the hot zone chamber. In the preferred embodiment the means for securing each rod to the outside wall is for the most part external to the wall and easily removable. The long sleeves are protected by shields from material, (in vapor form transmitted from a heated work piece) which ordinarily would adhere to such sleeves, build up and form a short circuit between the heating element and the rod (the rod being a path to ground). In addition the present invention provides compensating overlays which sandwich the heating element in proximity of the apertures so that current passing along the heating element finds a sufficient current path that the current density is not increased and hence burning out incidents are reduced or eliminated.

Figure 2:
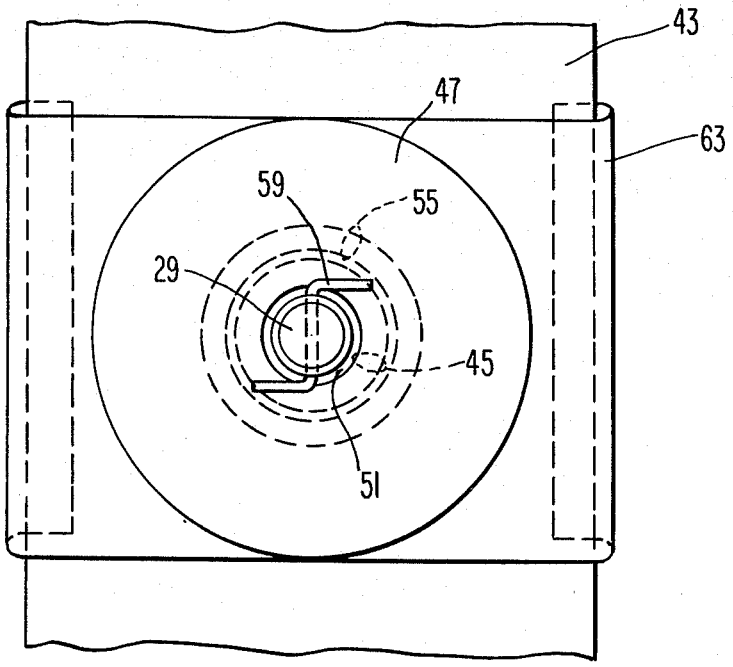

The objects and features of the present invention will be better understood from the following description taken in conjunction with the drawings wherein:

FIG. 1 is a cross-sectional side view of a portion of the present vacuum furnace arrangement; and FIG. 2 is a pictorial schematic of an end view of the heating element holder arrangement.

Consider FIG. 1, wherein there is shown a portion of a furnace wall 10 having a supporting means 12 in supporting arrangement with the ring section of the hot zone chamber 13. Also there is shown in FIG. 1 the outside wall 11, of the hot zone chamber 13. It should be understood that in the preferred embodiment the hot zone chamber 13 has an outside wall 11, which is generally cylinderically shaped but the hot zone chamber need not be that shape. The present invention can accommodate other shapes of furnaces. As can be gleaned from FIG. 1, the inside surface of the outside wall of the hot zone chamber has heat insulating means 15 secured thereto. The heat insulating means 15 is a means to impede the heat transmission from the heating chamber 17, through the wall 11. The heat insulating means 15 is made up, in the preferred embodiment, of a layer of KAOWOOL 19, a layer of graphite felt 21, and a sheet of Grafoil 23. KAOWOOL is manufactured by the Babcok and Wilcox Co., the graphite felt is manufactured by Union Carbide Co., and the Grafoil (trademark of Union Carbide) can be obtained from Union Carbide Co. It should be understood that other forms of heat impeding materials can be used or a heat reflecting shield could be used.

The heat insulating means is secured to the inside wall by having a retaining strap 25, or a retaining bar, disposed generally orthogonally to the sheet of Grafoil 23. The retaining strap 25 is held against the Grafoil 25, by the pin 27, which passes through the mounting rod 29.

It should be noted that the mounting rod 29 is threaded and is secured to the outer wall 11, by a threaded support socket 31 acting with a lock washer 33, and a nut 35. The rod 29, is threaded into the support socket 31, and the support socket 31, is disposed through the aperture 37, in the outer wall 11. The lock washer 33, is slipped over the external extension of the support socket 31, and the nut 35, is threaded onto the support socket to securely fix the mounting rod 29, to the outer wall 11. In addition there is a pin 39, press fitted into the support socket 31, to retain the nut 35, should it come loose. It should be borne in mind that the mounting rod 29, and support socket 31, in the preferred embodiment are made of molybdenum in order to be functional in the high temperature. Other suitable rigid materials which can withstand temperatures of 3000° F. could be used.

It should be understood that in the present furnace arrangement there are a number of mounting rods, such as mounting rod 29, disposed around the inner surface of the hot zone chamber to support the insulation material and to support the heating element as will be described hereinafter. It should also be noted from FIG. 1, that the heat insulation means 15, has an aperture therethrough to accommodate the location of the mounting rod 29.

As can be seen in FIG. 1, the mounting rod 29, passes through an aperture 41, formed in the heating element 43. But note that aperture 41, is formed large enough to accommodate the long electrical insulation sleeve 45. The long sleeve 45 is cylindrical in shape and fits over the mounting rod 29, and is placed through the aperture 41, of the heating element 43. In the preferred embodiment the long sleeve 45 is made from alumina, but other suitable ceramics could be used. Hence the heating element 43, is electrically isolated from the mounting rod 29. Bear in mind that the heating element 43, is made of molybdenum in the preferred embodiment and becomes a "heating element" by conducting electrical energy. The heating element is not formed into a complete circle but has two ends to which an electrical power source is connected. If the heating element 43, were not electrically isolated from the mounting rod 29, and the mounting rod were connected to ground (or some suitable voltage level), a short circuit would occur and in all probability damage would be done to the hot zone chamber and danger would be present for the user. The provision of the long sleeve 45, prevents to a great extend such undesirable possibilities.

However it has been found that when workpieces are heated in a vacuum furnace some of the material is given off in vapor form and passes to such insulating sleeves to form a "build up" thereon. When such vaporized material builds up on the insulation sleeve 45 it often causes a short circuit. Hence in my arrangement I have protected the long sleeve and have employed the protecting elements as means to secure and support the heating element 43.

As can be seen in FIG. 1, on either end of the long sleeve 45, there are located disc-like shields 47 and 49. In the preferred embodiment the shields 47 and 49 are large washers made of molybdenum but other suitable material could be used. The apertures 51 and 53 are formed large enough to permit the mounting rod 29, to pass therethrough, however, when the hot zone chamber is heated the washers 47 and 49 expand to come to rest on the mounting rod 29, thus providing a seal against material, in vapor form, passing past the shield to come to rest on the long sleeve 45 as well as on the rod 29.

As also can be seen in FIG. 1, there are two short electrical insulation sleeves 55 and 57 which are formed to fit over the long sleeve 45, and respectively between the disc-like shields 47 and 49, and the heating element 43. Note in FIG. 1, that the short sleeve 55, acts as spacer between the shield 47, and the heating element 43. Hence the shield 47, cannot become electrically shorted against the heating element 43. In like manner the short sleeve 57, acts as a spacer between the shield 49, and the heating element 43, so that there can be no electrical short circuit therebetween. In addition the short sleeves 55 and 57, act to block vaporized material from settling on the long sleeve 45, should any such material pass through the space between the shields 47 and 49 and the heating element 43. In actual practice I have observed that the material, in vaporized form, is transmitted from the workpiece in a "line-of-sight" fashion and does not readily bend the corner to pass in the space between the shields and the heating element.

The shielding and electrical insulating arrangement just described is locked into position on the mounting rod 29, by the pins 59 and 61. Hence the heating element is mounted on a plurality of mounting rods acting in conjunction with a plurality of similar shielding and electrical insulating arrangements. If the heating element should fracture or break due to thermal stress, or whatever, the mounting structure can be easily dismantled and the heating element repaired.

For instance one way of repairing a damaged heating element is to remove a section of the flat molydenum strip 43 and add a section, with suitable means to secure the added section to the original strip. Suitable means can be a molydenum clip, or rivets, or by cutting the added section as to have tabs which are bent onto the original strip. In order to make such a repair, of course, the rod assembly must be removed. The removal of the mounting rod 29, is accomplished by removing the pins 61 and 27, and threading the rod 29 out of the support socket 31. Thereafter the shields 47 and 49, along with the sleeves 45, 55 and 57 are removed. When the heating element is repaired, the sleeves and shields are reassembled and the rod 29 is passed therethrough, and further passed through the heat insulation layer 15, to be threaded into the socket 31. The pins 27 and 61 are replaced and the hot zone chamber is ready again for operation. Compared to a similar repair with the prior art vacuum furnace structure, the foregoing described disassembly and assembly is very easy to effect.

During the foregoing described repair the retaining bar 25, remains in place because it extends from one section to another and is mounted on more than one mounting rod.

Once again in FIG. 1, note the current compensating clip 63. The current compensating clip 63, has an aperture therein which is identical in size to the aperture in the heating element. However the additional electrically conducting material provided by the clip adds an additional path for electrical current thereby negating an increase in current density. By mitigating the possibility of increased current density, the likelihood of burning out the heating element at the aperture location is greatly reduced.

Consider FIG. 2, which shows an end view of the heating element mounting means. As can be well appreciated from FIG. 2, the mounting rod 29, passes through the aperture 51, of the shield 47, and the pin 59 retains the shield 47, in place. As can also be well understood from FIG. 2, the long sleeve 45, fits over the rod 29, and it has an inside diameter which is as large or larger than the aperture 51, so that it must be retained by the shield 47. As can be further gleaned from FIG. 2, the short sleeve 55, fits over the long sleeve 45, to form an intercepter means against material, in vapor form, passing over or around the shield toward sleeve 45. The arrangement of the current compensator 63, can be readily understood from FIG. 2. Actually the bend of the compensator 63, around the heating element 43, is exaggerated in FIG. 2, for demonstrative purposes. The shield fits simply around the ends of the heating element 43.

The present invention as described in detail above provides a heating element mounting means which is easily assembled and disassembled, which reduces electrical shorts due to vaporized material from a workpiece and which electrically insulates the heating element from other conducting elements in the furnace.

I claim:

1. A hot zone chamber arrangement for use in a vacuum furnace having an improved means for mounting the heating element therein comprising in combination: hot zone chamber means having a wall with outer and inner surfaces and wherein said inner surface defines a substantially open chamber, said wall having an aperture therein; means to impede heat transmission having an aperture therein and secured to said inside surface; threaded support means secured to said wall and formed to have a receiving threaded section located through said aperture in said wall; threaded mounting rod means threadably disposed within said threaded support means and disposed to pass through said aperture in said means to impede heat transmission into said substantially open chamber; heating element means disposed within said open chamber and inwardly away from said means to impede heat transmission, said heating element means formed to hve an aperture therein and disposed to have said rod pass therethrough; electrical insulation means disposed between said heating element and said rod but formed to secure said rod with said heating element and further formed and disposed to be easily removable from securing said heating element to said rod when said rod is unthreaded from said threaded support means.

2. A hot zone chamber arrangement according to claim 1, wherein there is further included shield means formed to fit over said rod means and disposed in close proximity to the ends of said electrical insulation means to keep vaporized material from forming on said electrical insulation means.

3. A hot zone chamber arrangement according to claim 1, wherein said electrical insulation means includes a base sleeve member formed and disposed to fit over said rod means through said aperture in said heating element and further formed to provide first and second extensions respectively on either side of said heating element and further includes first and second larger diameter sleeve members formed and disposed to fit respectively over said first and second extensions.

4. A hot zone chamber arrangement according to claim 3, wherein first and second shield members are formed and disposed to fit over said rod in close proximity respectively to the ends of said first and second extensions whereby said base sleeve member and first and second larger diameter sleeve members are located therebetween.

5. A hot zone chamber arrangement according to claim 4, wherein said base sleeve member is disposed to pass through said heating element and said first and second larger diameter sleeve members are disposed between said heating element means and said shield means.

6. A hot zone chamber arrangement according to claim 1, wherein there is further included a current compensating means having an aperture therein and formed and disposed to fit with said rod means passing through said aperture adjacent to said aperture in said heating element means and secured to be in contact with said heating element means whereby electrical current is conducted through said current compensating means simultaneously with being conducted through said heating element means at the location surrounding said aperture in said heating element means.

7. A hot zone chamber arrangement according to claim 1, wherein said means to impede heat transmission comprises layers of graphite holding materials.

8. A hot zone chamber arrangement according to claim 1, wherein there is included a support bar means formed to fit over said rod means and disposed in abutment with said means to impede heat transmission and wherein there is further included locking means secured to said rod means and disposed adjacent said support bar means to keep said support bar means in abutment with said means to impede heat transmission.

9. A hot zone chamber arrangement according to claim 1, wherein said treaded support means includes an internally threaded support socket which is further formed to have a flange section disposed in abutment with said inner surface and formed to have a protruding section extending from said flange section through said aperture said protruding section formed to have an external thread thereon and wherein said threaded support means further includes a nut threadably engaged on said protruding section.

* * * * *